US008277166B2

(12) United States Patent
Tecza et al.

(10) Patent No.: US 8,277,166 B2
(45) Date of Patent: Oct. 2, 2012

(54) USE OF NON-UNIFORM NOZZLE VANE SPACING TO REDUCE ACOUSTIC SIGNATURE

(75) Inventors: Joseph Andrew Tecza, Scio, NY (US); Stephen Samuel Rashid, Wellsville, NY (US)

(73) Assignee: Dresser-Rand Company, Olean, NY (US)

( * ) Notice: Subject to any disclaimer, the term of this patent is extended or adjusted under 35 U.S.C. 154(b) by 639 days.

(21) Appl. No.: 12/486,501

(22) Filed: Jun. 17, 2009

(65) Prior Publication Data

US 2010/0322755 A1 Dec. 23, 2010

(51) Int. Cl.
*F01D 9/04* (2006.01)

(52) U.S. Cl. ..... 415/1; 415/119; 415/194; 415/195; 415/208.2

(58) Field of Classification Search ..... 415/1, 119, 415/191, 194, 195, 208.2, 211.2, 210.1, 189, 415/190, 209.2, 209.4
See application file for complete search history.

(56) References Cited

U.S. PATENT DOCUMENTS

| | | | | |
|---|---|---|---|---|
| 1,534,721 | A | 4/1925 | Lasche | |
| 3,006,603 | A | 10/1961 | Caruso et al. | |
| 3,347,520 | A | 10/1967 | Owczarek | |
| 4,253,800 | A | 3/1981 | Segawa et al. | |
| 5,975,843 | A | 11/1999 | Ebihara | |
| 6,409,472 | B1 * | 6/2002 | McMahon et al. | 415/189 |
| 6,439,838 | B1 | 8/2002 | Crall et al. | |
| 7,097,420 | B2 | 8/2006 | Cormier et al. | |
| 7,118,331 | B2 * | 10/2006 | Shahpar | 415/195 |
| 2004/0146396 | A1 | 7/2004 | Liu | |

FOREIGN PATENT DOCUMENTS

| | | | |
|---|---|---|---|
| EP | 1586741 | A2 | 10/2005 |
| EP | 1772596 | A2 | 11/2007 |
| GB | 777955 | A | 7/1957 |
| GB | 2471151 | A | 12/2010 |

OTHER PUBLICATIONS

GB1004343.8 Search Report issued Jun. 16, 2010 (4 pages).

* cited by examiner

*Primary Examiner* — Igor Kershteyn
(74) *Attorney, Agent, or Firm* — Edmonds & Nolte, PC

(57) ABSTRACT

A stator for a turbomachine. The stator includes a plurality of nozzle vanes, with the distance between each of the plurality of nozzle vanes varying circumferentially around the stator in a repeating pattern configured to distribute a vibration energy over a plurality of side band vibration frequencies around a nominal passing frequency in a rotor.

15 Claims, 6 Drawing Sheets

USE OF NON-UNIFORM NOZZLE VANE SPACING TO REDUCE ACOUSTIC SIGNATURE

BACKGROUND

In a turbomachine, such as a turbine, a working fluid is compressed to a high-pressure and then forced between nozzle vanes on a stator to blades of a rotor, which transfers energy from the working fluid to a shaft attached to the rotor. This energy transfer may also create noise. The noise may be created in any of several manners, including when the rotor vibrates in reaction to forces applied by the working fluid on the blades. The working fluid is channeled toward the blades by the nozzle vanes of the stator. In channeling the working fluid, the nozzle vanes also create wakes in the working fluid. Each wake represents an area of decreased velocity in the working fluid relative to the free stream velocity, and therefore, the working fluid in the wakes causes a change in the force on the blades. After the blade passes through the wake, the force applied by the working fluid returns to a relatively constant level until the blade reaches the next wake. This periodic change in forces may cause vibration. The nozzle vanes are generally uniformly spaced apart, so a given blade engages the wakes at a relatively constant rate. This periodic engagement of the wakes can cause a concentration of the vibration energy at a single frequency, thereby focusing substantially all of the vibration energy into a peak amplitude, and maximizing the amplitude of the noise. Thus, there is a need for an arrangement of nozzle vanes on the stator that spreads the vibration energy among two or more frequencies, instead of focusing all of the vibration at a single frequency, without causing imbalance or unnecessary axial thrust.

SUMMARY

Embodiments of the disclosure may provide a stator for a turbomachine. The stator includes a plurality of nozzle vanes, with the distance between each of the plurality of nozzle vanes varying circumferentially around the stator in a repeating pattern configured to distribute a vibration energy over a plurality of side band vibration frequencies around a nominal passing frequency in a rotor.

Embodiments of the disclosure may further provide an exemplary turbomachine. The exemplary turbomachine includes a rotor and a stator. The stator is in fluid communication with the rotor, and has first nozzles each having a first profile and second nozzles each having a second profile that is larger than the first profile. The first and second nozzles are disposed in a repeating pattern such that a vibration energy in the rotor is distributed among a plurality of side band vibration frequencies around a nominal passing frequency.

Embodiments of the disclosure may also provide an exemplary method of reducing an acoustic signature. The exemplary method includes providing a stator having nozzle vanes. The exemplary method also includes spacing the nozzle vanes apart non-uniformly to define non-uniform nozzles therebetween, wherein the non-uniform nozzles are arranged in a repeating pattern, and creating wakes in a working fluid using the nozzle vanes, wherein each of the wakes corresponds to a separate one of the nozzle vanes. The exemplary method further includes intersecting the wakes with blades on a rotor as the rotor turns, and transferring energy from the working fluid to a vibration energy in the rotor. The exemplary method also includes distributing the vibration energy among a plurality of side band vibration frequencies around a nominal passing frequency.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
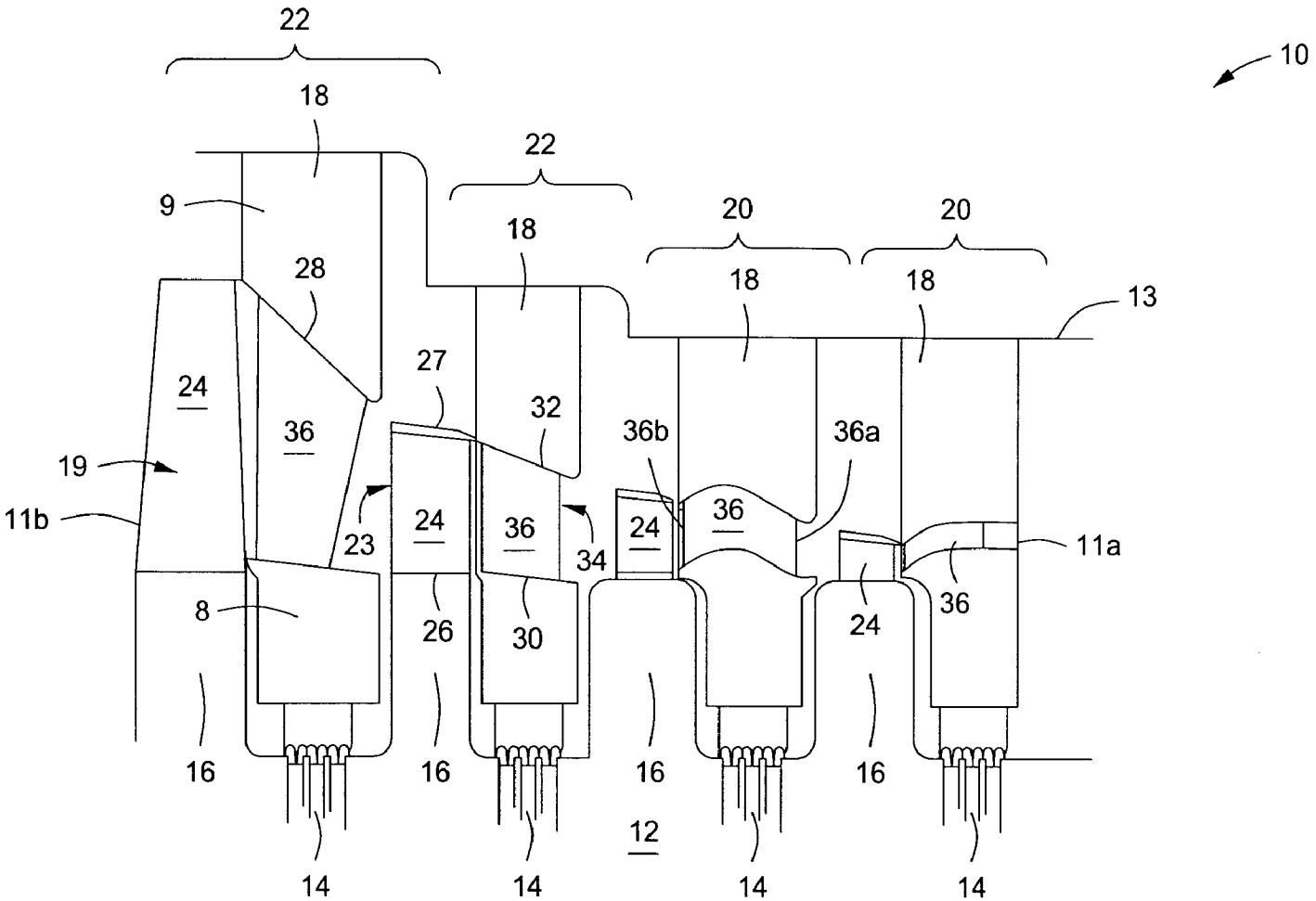
FIG. 1 illustrates a partial cross-sectional view of an exemplary turbine in accordance with the disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

FIG. 1 illustrates a turbomachine, specifically, a turbine 10, which may, for example, be a steam turbine 10. The turbine 10 includes a fluid passageway 19, a portion of which is defined between locations 11*a* and 11*b*, with location 11*a* being upstream from location 11*b*. The turbine 10 may also include a shaft 12, a casing 13, seals 14, rotors 16 and stators 18.

Each rotor 16 is disposed around the shaft 12 and may engage the shaft 12, or may be formed integrally with the shaft 12, such that the rotor 16 rotates along with the shaft 12. The rotor 16 is generally annular, and has an interior side 26, an exterior side 27, and an annular portion 23 defined between the interior and exterior sides 26, 27, with the annular portion 23 being at least partially disposed in the fluid passageway 19. The rotor 16 further includes blades 24, which may be disposed in the annular portion 23 and may extend between the interior side 26 and the exterior side 27.

Each stator 18 may also be disposed around the shaft 12, but may be attached to the casing 13, or another generally fixed body in the turbine 10, such that the stator 18 may be configured to remain stationary with respect to the rotor 16. One of the seals 14 may be interposed between each of the stators 18 and the shaft 12 to prevent substantial leakage therebetween. Each stator 18 may include a concentric pairing of an annular retaining disc 8 and an annular retaining ring 9, with the retaining disc 8 located inside and spaced radially apart from the retaining ring 9. The radial space between the retaining disc 8 and the retaining ring 9 may be referred to as an outer ring 34. The outer ring 34 may have an inner endwall 30 connected to the retaining disc 8 and an outer endwall 32 connected to the retaining ring 9. Accordingly, the inner and outer endwalls 30, 32 may each be annular, or ring-shaped, and disposed concentrically such that the inner endwall 30 resides radially inside the outer endwall 32.

Further, each of the inner and outer endwalls 30, 32 may be constructed of a single piece of metal (or other suitable material), such that the inner endwall 30 is continuous and the outer endwall 32 is similarly continuous. Alternatively, the inner and outer endwalls 30, 32 may be broken apart along a diametral line for ease of assembly and disassembly. Inner slots (not shown) may be cut into the inner endwall 30 and outer slots (not shown) may be cut into the outer endwall 32 by waterjet cutting or by another appropriate method, with each inner slot on the inner endwall 30 aligned with an outer slot on the outer endwall 32. Slid into each pair of aligned inner and outer slots and extending radially between the inner and outer endwalls 30, 32 are a plurality of nozzle vanes 36. Each of the nozzle vanes 36 may have a leading edge 36*a*, defining the upstream axial edge of the nozzle vane 36, and a trailing edge 36*b* defining the downstream axial edge of the nozzle vane 36.

As the nozzle vanes 36 are located in slots cut in the inner and outer endwalls 30, 32, it is a simple matter to locate the individual nozzle vanes 36 with either a fixed circumferential pitch, or with slight changes in the circumferential locations of the individual stators 18 by changing the position of the slots. Along with this advantageous ease of positioning, the structural integrity of the stator 18 is not compromised as may be the case with stators that are split along multiple diametral lines or radii into, for example, wedges that must held together for operation.

Additionally, each of the rotors 16 may be adjacent to a separate one of the stators 18 and in fluid communication therewith, thereby defining stages 20 and 22. In an exemplary embodiment, two of the rotors 16 and stators 18 are configured to create two impulse stages 20, and two of the rotors 16 and stators 18 are configured to create two reaction stages 22. It will be apparent that other arrangements of the stages 20, 22 may be employed, and the exemplary arrangement of the impulse stages 20 and reaction stages 22 is not to be considered limiting. Additionally, the stages 20 and 22 may include additional rotors 16 and/or stators 18 where appropriate.

Figure 2:
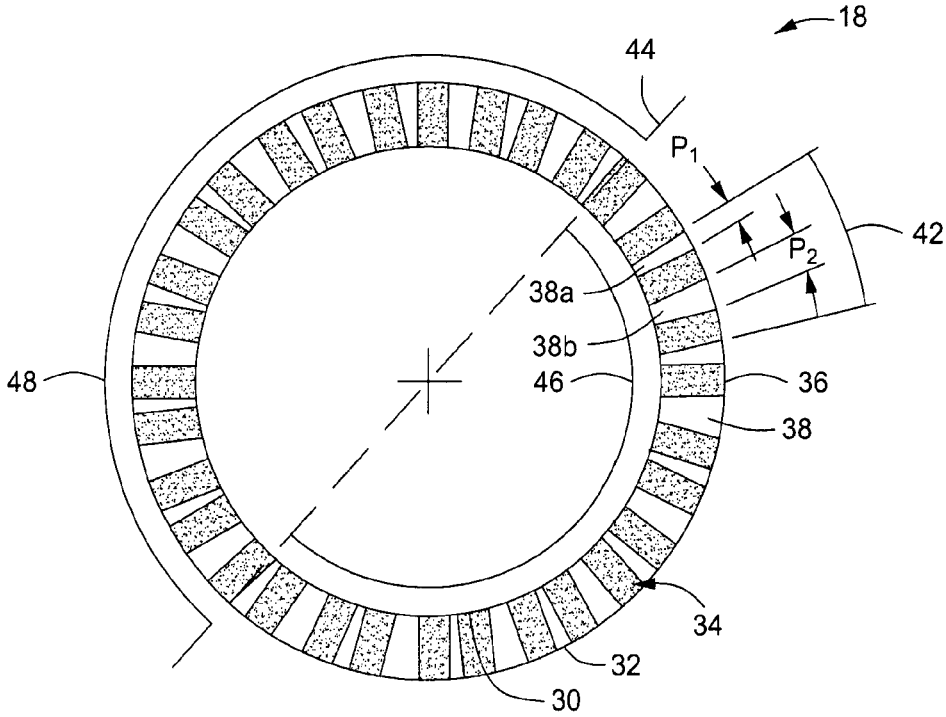
FIG. 2 illustrates a partial axial view of an exemplary embodiment of a stator in accordance with the disclosure.

FIG. 2 illustrates a partial axial view of an exemplary embodiment of one of the stators 18. As described with reference to FIG. 1, the nozzle vanes 36 may be located, or defined, in the outer ring 34, and may extend radially between the inner endwall 30 and the outer endwall 32. The nozzle vanes 36 are circumferentially spaced apart such that circumferentially adjacent nozzle vanes 36 may be described as adjacent pairs of nozzle vanes 36. Between each adjacent pair of nozzle vanes 36, there is defined a nozzle 38. It will be appreciated that two pairs of adjacent nozzle vanes 36 define two nozzles 38, but may together include three nozzle vanes 36. More particularly, one of the pairs of adjacent nozzle vanes 36 may include a first nozzle vane and a second nozzle vane, while another of the pairs of adjacent nozzle vanes 36 may include a third nozzle vane and also the second nozzle vane, such that the second nozzle vane is part of both pairs of adjacent nozzle vanes 36. In other embodiments, the pairs of adjacent nozzle vanes 36 may include unshared nozzle vanes.

Each nozzle 38 has a profile. The profile is defined herein as the average circumferential distance between two adjacent nozzle vanes 36 measured between the trailing edges 36*b* (shown in FIGS. 1 and 5) of each nozzle vane 36. It will be appreciated that the space between the nozzle vanes 36 may curve or bend, and may or may not remain the same size, proceeding axially between the leading and trailing edges 36*a*, 36*b*. Further, the space between adjacent nozzle vanes 36 may increase or decrease in size proceeding radially outwards along the nozzle vanes 36. However, even in such embodiments, the definition of the profile remains the average distance between trailing edges 36*b* of adjacent nozzle vanes 36.

In an exemplary embodiment, the stator 18 has nozzles 38 with different profiles according to the circumferential distance between each of the nozzle vanes 36. More particularly, the distance between each of the nozzle vanes 36 may vary, thereby defining nozzles 38 having the different profiles. Accordingly, the nozzles 38 may include a first nozzle 38*a* and a second nozzle 38*b*. The first nozzle 38*a* has a first profile $P_1$ and the second nozzle 38*b* has a second profile $P_2$. For ease of illustration, the first and second profiles $P_1$, $P_2$ are shown as the overall circumferential distance between the nozzle vanes 36 in FIG. 2 (and also FIG. 3, as later described), but the definition of profile as expressed herein remains unchanged. Additionally, the arrangement of the nozzles 38 between the nozzle vanes 36 may create a pattern 42 of nozzles 38. The pattern 42, as shown, may be any sequence of the first and second nozzles 38*a*, 38*b*. Additionally, the stator 18, as shown, may include a plurality of the first and second nozzles 38*a*, 38*b*, and, further, the pattern 42 may include a sequence that incorporates the first and second nozzles 38*a*, 38*b*.

Further, the ratio of the number of first nozzles 38*a* to the number of second nozzles 38*b* in the sequence of the pattern 42 is not necessarily one to one. For example, the sequence may be a single first nozzle 38*a* followed by several second nozzles 38*b*, or vice versa, and thereafter repeating the sequence, or even beginning another sequence. Further, the first and second nozzles 38*a*, 38*b* may be arranged around the stator 18 such that the pattern 42 repeats. As shown in FIG. 2, the pattern 42 may follow a repeating sequence of one first nozzle 38*a* followed by one second nozzle 38*b*. In this manner, the pattern 42 of nozzles 38 may be a consecutively alternating sequence of the first nozzles 38*a* and the second nozzles 38*b*, such that each first nozzle 38*a* is adjacent to at least one (usually two, one on each side) second nozzles 38*b*. In the exemplary embodiment shown in FIG. 2, about half of the nozzles 38 are first nozzles 38*a* and half include second nozzles 38*b*.

A diametral line 44 may be drawn through the stator 18 as shown. In exemplary operation, it is advantageous to evenly distribute the flow areas and velocities such that the force on the rotor blades 24 (FIG. 1) due to fluid impingement is about the same across any given diametral line 44. As explanation, even though the stator 18 does not rotate, maintaining a substantial balance in the flow areas and fluid velocities of the stator 18 may reduce the potential for uneven axial thrust forces applied on the shaft 12 of the turbine 10 (shown in FIG. 1), and/or may avoid unnecessary bearing load changes and vibration in the turbine 10. In contrast, if the forces creating torque for a particular rotor stage 20, 22 (FIG. 1) are not balanced across a diametral line 44, a side load may be generated potentially resulting in an increased load on the rotor bearings (not shown) of the turbine 10. For obvious reasons, this result is undesirable.

The diametral line 44 bisects the stator 18, forming first and second 180 degree sections 46, 48, which may also be described herein as first and second halves 46, 48 of the stator 18. The nozzle vanes 36 are distributed between the first and second halves 46, 48, such that a first number of nozzle vanes 36 are located in the first half 46 and a second number of nozzle vanes 36 are located in the second half 48. To maintain a substantial force balance resulting from the stator 18, and therefore a resulting torque balance, the sum of the flow areas of the nozzles 38 in each of the two halves 46, 48 may be substantially equal (e.g., within about 10%). To create this balanced flow area, the first number of nozzle vanes 36, and therefore nozzles 38, may be about equal to the second number, regardless of the pattern 42 chosen. "About equal" is generally defined to mean plus or minus one, such that in an exemplary embodiment where the first and second numbers are about equal, the first number may be one greater or one less than the second number. For complete balancing of the forces, the first and second numbers may be about equal regardless of where the diametral line 44 is drawn, so long as the diametral line 44 evenly bisects the stator 18. Alternatively, nozzle vanes 36 having different sizes may also be employed to balance the stator 18. In other embodiments, other arrangements of nozzles 38 may be used to balance the flow areas across the diametral line 44.

Figure 3:
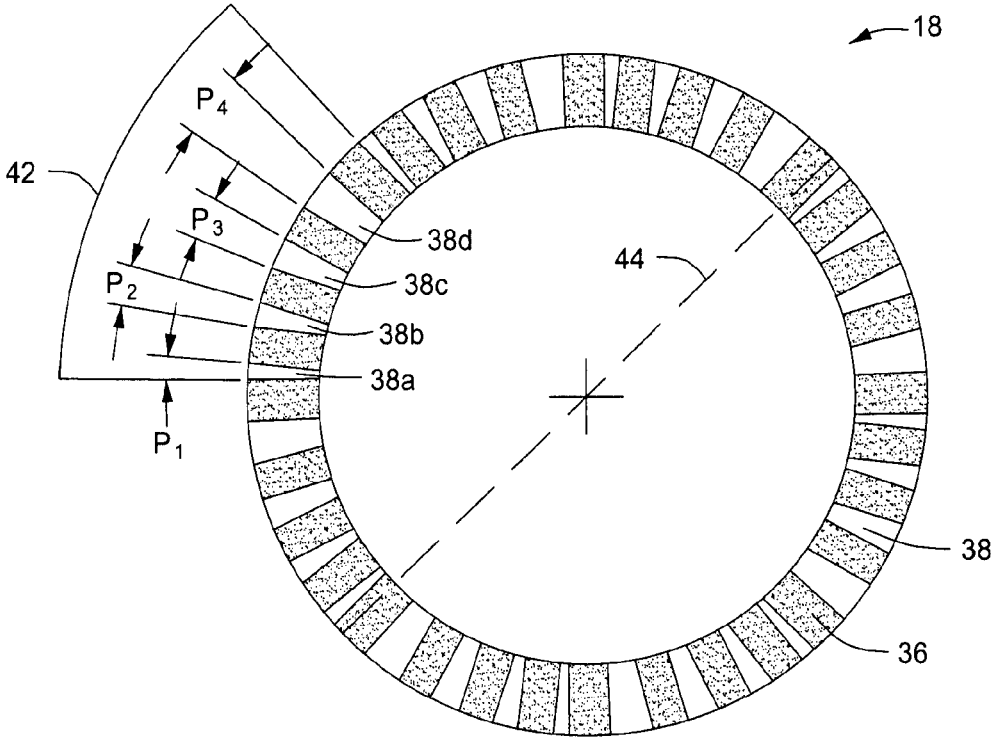
FIG. 3 illustrates a partial axial view of another exemplary embodiment of a stator in accordance with the disclosure.

FIG. 3 illustrates another exemplary embodiment of the stator 18 having a different pattern 42 of nozzles 38 between the nozzle vanes 36. As illustrated, the exemplary embodiment may further include a third nozzle 38*c* and a fourth nozzle 38*d* in addition to the first and second nozzles 38*a*, 38*b* already described with reference to FIG. 2. The third nozzle 38*c* has a third profile $P_3$ that may be larger than the second profile $P_2$, and the fourth nozzle 38*d* has a fourth profile $P_4$ that may be larger than the third profile $P_3$. Further, the nozzles 38 may include a plurality of each of the first, second, third, and fourth nozzles 38*a-d*, each having a respective profile $P_{1-4}$ as described. Additionally, as described with reference to FIG. 2, a diametral line 44 may be drawn through the stator 18, and the nozzle vanes 36 may be positioned around the stator 18 such that the forces may be balanced about the diametral line 44.

Similar to the embodiments described in FIG. 2, the nozzles 38*a-d* may be arranged on the stator 18 in a particular pattern 42. For example, the pattern 42 may include at least one of each of the first, second, third and fourth nozzles 38*a-d*. Alternatively, the pattern 42 may proceed according to the following repeating sequence: one of the first nozzles 38*a*, one of the second nozzles 38*b*, one of the third nozzles 38*c*, and one of the fourth nozzles 38*d*. The pattern 42 may also be one of the first nozzles 38*a*, two of the second nozzles 38*b*, four of the third nozzles 38*c*, and three of the fourth nozzles 38*d*, or the pattern 42 may be any other sequence. In an alternative exemplary embodiment, the pattern 42 may include only the first, second and third nozzles 38*a-c* (structure not shown). In such an embodiment, the pattern 42 may include any sequence of the first, second, and third nozzles 38*a-c* between adjacent pairs of the nozzle vanes 36. For example, one possible pattern 42 may be a repeating sequence of one of the second nozzles 38*b*, one of the third nozzles 38*c*, and one of the first nozzles 38*a*. Further, the stator 18 may include additional nozzles 38 having additional profiles (structure not shown).

Figure 4:
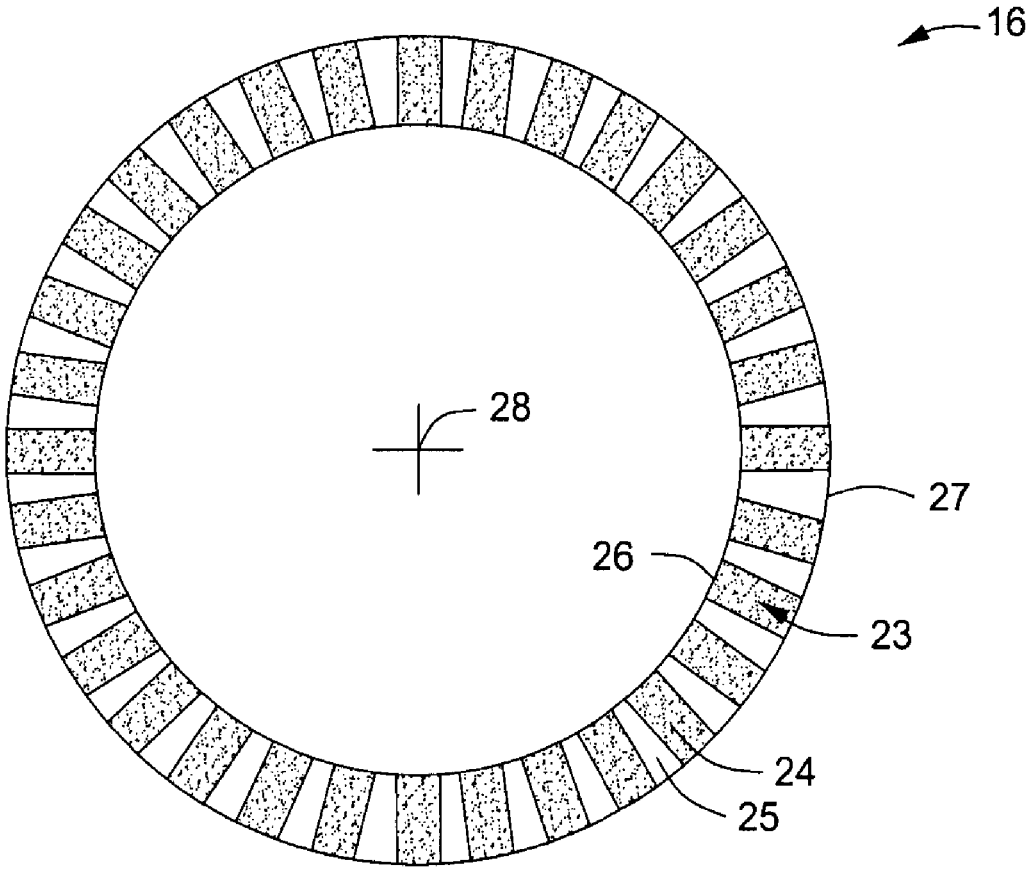
FIG. 4 illustrates a partial axial view of an exemplary rotor in accordance with the disclosure.

FIG. 4 illustrates an axial view of an exemplary embodiment of a portion of one of the rotors 16. The blades 24 may be disposed in the annular portion 23 and may extend between the interior side 26 and the exterior side 27, as described with reference to FIG. 1. Between each blade 24, there is defined a space 25. The rotors 16 are configured to rotate about a central axis 28 at a rapid rate, which is defined in the particular application. Accordingly, the rotors 16 may each be balanced to avoid radial vibratory forces due to unbalance, which in turn may result in radial vibration of the rotor system. For example, radial vibratory forces may occur when one portion of a rotating body (e.g. the rotor 16) is heavier than another portion of the rotating body, thereby causing the rotating body to deviate from a circumferential path leading to suboptimal efficiency. Therefore, since the blades 24 of the rotor 16 have a finite weight, the spaces 25 may be of a uniform size such that the blades 24 may be substantially uniformly spaced around the rotor 16, balancing the rotor 16 to minimize radial vibratory forces. However, the rotor 16 may be configured to minimize vibration in other ways as well.

Figure 5:
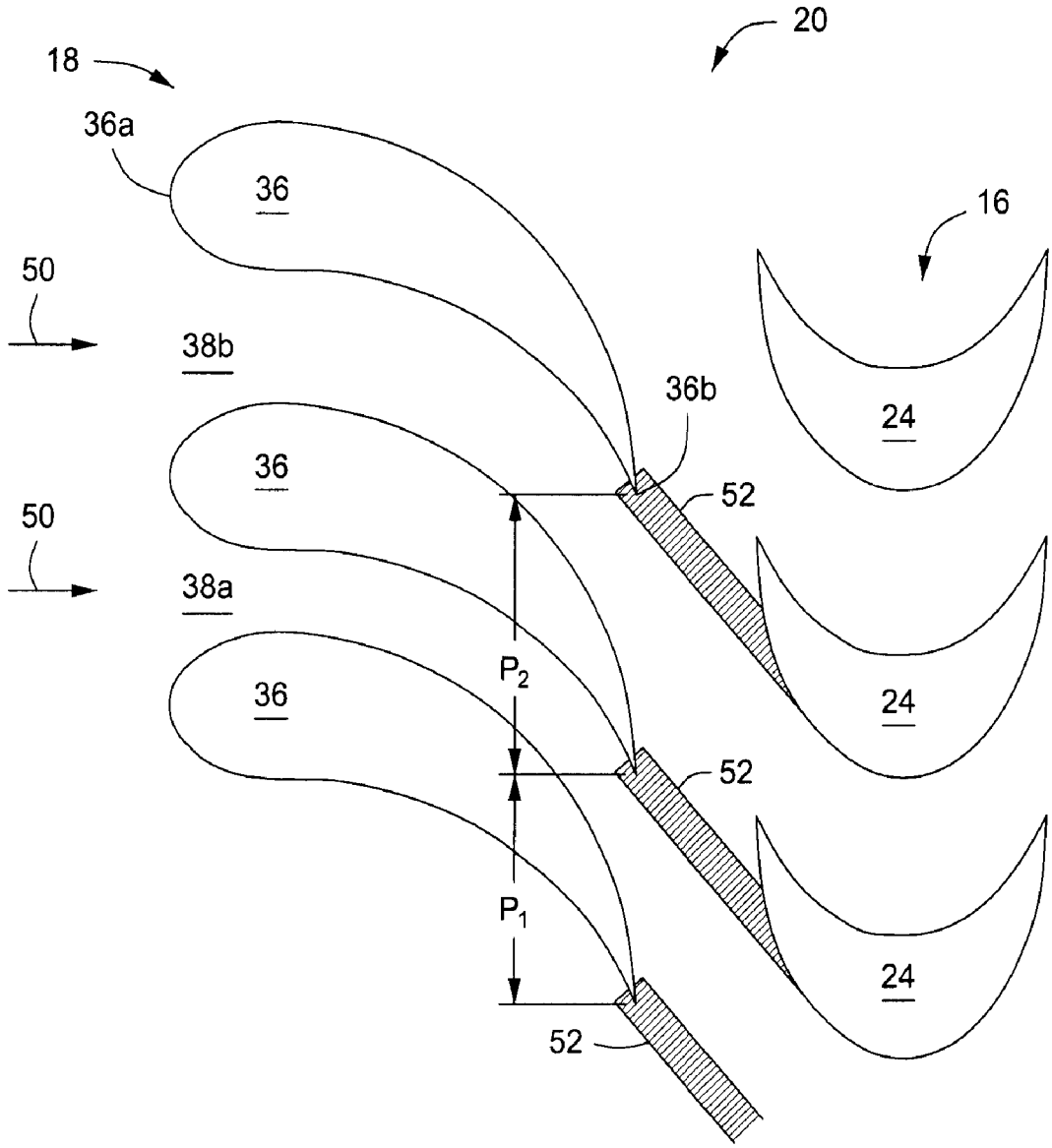
FIG. 5 illustrates a partial cross-sectional view of an exemplary stage in accordance with the disclosure.

FIG. 5 illustrates an embodiment of the nozzle vanes 36 of the stator 18 channeling a working fluid 50 toward the blades 24 of the rotor 16 in one of the impulse stages 20. It will be appreciated, however, that embodiments of the nozzle vanes 36 may also be employed in the reaction stages 22, shown in FIG. 1. In FIG. 5, the working fluid 50, which may be steam, air, products of combustion, or a process fluid such as carbon dioxide or other fluid, is channeled through the first and second nozzles 38*a*, 38*b*, and more specifically, between the leading edges 36*a* of adjacent pairs of the nozzle vanes 36, and through the first and second nozzles 38*a*, 38*b* having the first profile $P_1$ and the second profile $P_2$, respectively. After passing through the nozzles 38*a*, 38*b*, the working fluid 50 engages the blades 24. In an alternative exemplary embodiment additionally including the third and fourth nozzles 38*c*, 38*d* as shown in FIG. 3, the channeling is essentially the same as that shown in FIG. 5: the working fluid 50 is channeled through the nozzles 38*a-d* and into the blades 24 (not shown).

When the fluid flow field of the working fluid 50 is substantially constant, i.e., between the nozzle vanes 36, the forces applied on the blades 24 by the working fluid 50 are also relatively constant. However, each of the nozzle vanes 36 disrupts the flow of the working fluid 50, thereby each creating a wake 52 that corresponds to the nozzle vane 36 and may be proximal to the trailing edge 36*b*. A given one of the blades 24 traverses, or intersects, one of the wakes 52 each time the blade 24 passes circumferentially by the nozzle vane 36. Since the wakes 52 may not have the same characteristics as the rest of the fluid flow field, the working fluid 50 in the wakes 52 may apply a different force on the blade 24 than the working fluid 50 outside of the wakes 52 applies. Accordingly, when each wake 52 engages the blades 24, the wake 52 may thereby produce a disruption in what might otherwise be a relatively stable force-to-time relationship on the blade 24. Since the rotor 16, upon which the blade 24 is located, rotates at a relatively constant speed overall, each blade 24 may encounter the wakes 52 at a relatively constant rate, leading to cyclic disruptions in the force applied on the blades 24.

When one of the wakes 52 engages one of the blades 24, the rate at which the blade 24 is motivated may change, increasing or decreasing according to the change in force applied. The change in force and, relatedly, rate, may potentially occur repeatedly, and rapidly, for the short period of time that the blade 24 is in the wake 52. This may cause the rotor 16 to shake or vibrate, thereby creating, or at least adding to, an undesired acoustic signature.

The numbers of nozzle vanes 36 and rotor blades 24 in a stage 20, 22 are generally not the same, but are chosen to minimize the possibility of exciting unwanted vibration in the rotor 16 (FIG. 1). As is known in the art, stages consisting of the same number of blades 24 and nozzle vanes 36 typically create large torque "ripples" incident on the shaft 12. By instead employing unequal numbers of nozzle vanes 36 and rotor blades 24, a designed-in difference in engagement times causes vibratory force excitation not only at the fundamental passing frequency of the blades 24 passing the wakes 52, but also at harmonic multiples of this frequency. Thus, embodiments of the present disclosure may be configured to lower the amplitudes of vibration at the passing and harmonic frequencies by modulating the arrival times of the uneven forces, as described below with reference to FIGS. 6A and 6B.

Figure 6A:
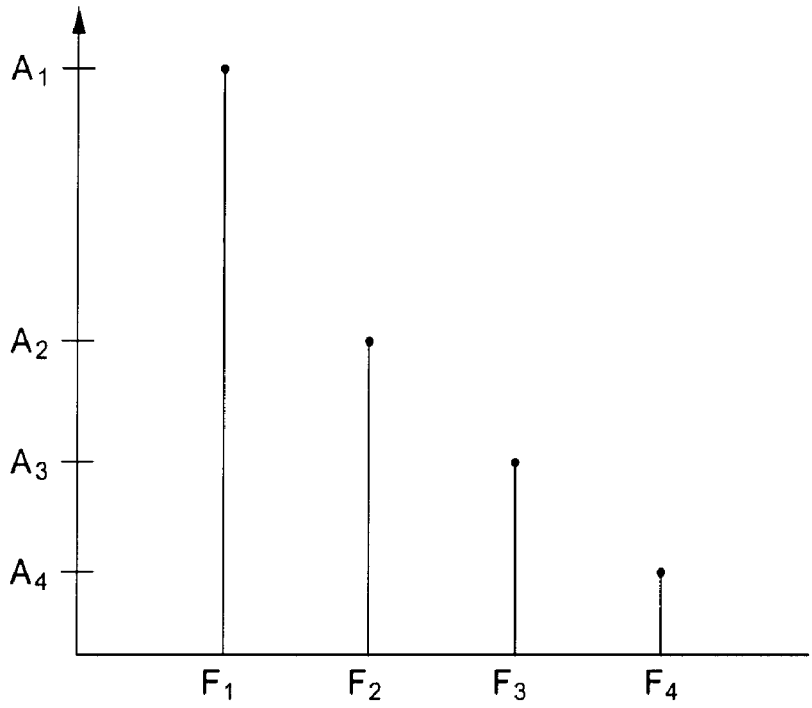
FIGS. 6A-6B illustrate exemplary frequency spectrum plots of vibration amplitudes as a function of frequency in accordance with the disclosure.
Figure 6B:
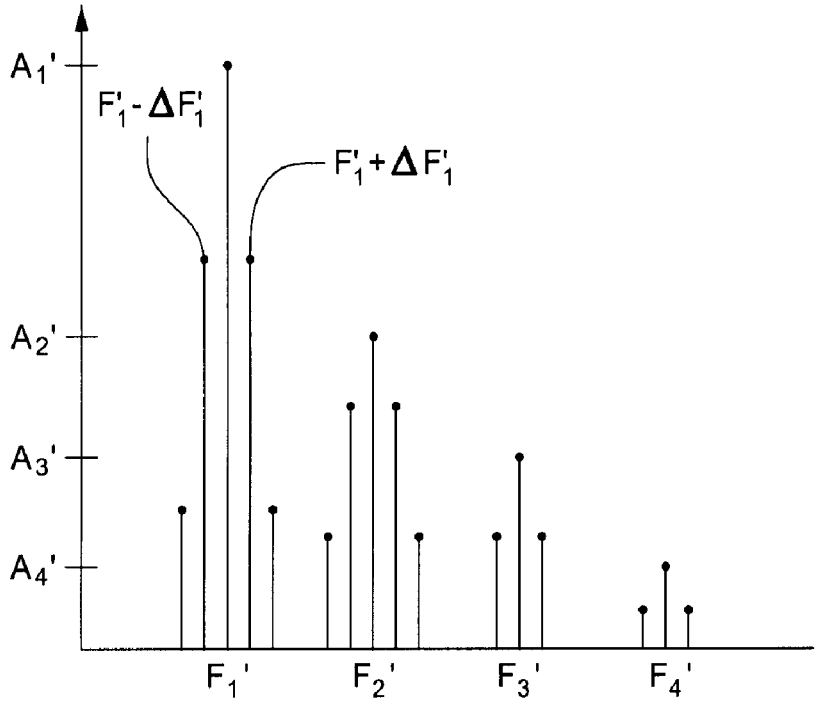

Referring now to FIGS. 6A and 6B, with continuing reference to FIGS. 2, 3, and 5, illustrated is the vibration amplitude caused in the rotor 16 by the wakes 52 periodically engaging the blades 24 as a function of frequency. Vibration in the rotor 16 reflects inefficiency and creates sound. In certain applications, the sound may result in an undesired acoustic signature. It will be appreciated that these depictions are merely exemplary, and that different relative amplitudes among the various frequencies are contemplated herein.

FIG. 6A depicts the typical pressure amplitude spectrum generated with an equal nozzle vane 36 spacing. With constant nozzle vane 36 spacing, a frequency spectrum plot is expected to show a peak at passing frequency $F_1$ and additional peaks at the run-speed harmonics $F_2$, $F_3$, and $F_4$, as described above with reference to FIG. 5. If the nozzle vanes 36 were spaced apart by a single nozzle 38 (structure not shown), the nozzle vanes 36 would likely create uniformly spaced apart wakes 52, thereby creating a vibration energy that produces a peak amplitude $A_1$ of vibration in the rotor 16 at the passing frequency $F_1$ and harmonic vibrations at frequencies $F_2$, $F_3$, and $F_4$, with amplitudes of $A_2$, $A_3$, and $A_4$, respectively. It will be appreciated that additional harmonic frequencies at higher multiples of the passing frequency would also be expected, but for ease of description, are not further discussed.

FIG. 6B depicts an exemplary frequency spectrum generated with unequal nozzle vane 36 spacing as described with reference to FIGS. 2, 3 and 5. The vibration energy is shown in FIG. 6B distributed into a plurality of "side band" vibration frequencies near or around the average, or nominal, passing frequency $F_1'$ and the harmonic frequencies $F_2'$-$F_4'$ caused by the non-uniform nozzle vane 36 spacing. This distribution of energy is also known as "smearing" the amplitude of the vibration. With non-uniform nozzle vane 36 spacing, the resulting frequency spectrum plot shows a reduced peak amplitude $A_1'$ at the nominal passing frequency $F_1'$ as vibration energy that would otherwise go to an increased peak amplitude is instead consumed by the addition of amplitudes in the side band vibration frequencies. For example, the vibration may be distributed to a first side band frequency at $F_1'+\Delta F_1'$, a second side band frequency at $F_1'$, and a third side band frequency at $F_1'-\Delta F_1'$, where the frequency increments represented by $\Delta F_1'$ correspond to the changes in nozzle vane 36 spacing multiplied by the nominal passing frequency. Additional side band vibration frequencies, as shown, may also develop according to the pattern 42 and nozzles 38*a-d* included in the embodiment. Similarly, at each nominal harmonic frequency $F_2'$-$F_4'$, the peak amplitudes are reduced to $A_2'$-$A_4'$ as the vibration energy is smeared into the side band vibration frequencies around the nominal harmonic frequencies $F_2'$-$F_4'$.

Accordingly, in an embodiment having first and second nozzles 38*a*, 38*b*, the inclusion of the second nozzles 38*b* with the second profile $P_2$ that is slightly larger than the first profile $P_1$ of the first nozzle 38*a* may result in blades 24 passing the nozzles 38*a*, 38*b* at a frequency equal to the ratio of the relative circumferential spacings multiplied by the nominal passing frequency $F_1'$. In other words, due to the spacing of the varying patterns 42, the blades 24 will pass groups of nozzle vanes 36 with the changed spacing at different frequencies around the nominal passing frequency $F_1'$, which will be around the nominal passing frequency $F_1'$, that is, either slightly higher with a smaller spacing (i.e., $F_1'+\Delta F_1'$) or slightly lower with a larger spacing (i.e., $F_1'-\Delta F_1'$). This creates the side band vibrations as the excitation in the blades 24 caused by the intersection with the wakes 52 is smeared. Similarly, side band vibrations will be created around the frequencies of the subsequent harmonics frequencies $F_2'$-$F_4'$, with these side bands also being at frequencies substantially equal to the ratio of the relative circumferential spacings multiplied by the respective nominal harmonic frequency.

With reference to the exemplary embodiment including the third and fourth nozzles 38*c*, 38*d* as depicted in FIG. 3, FIG. 6B further illustrates that the process of smearing the peak amplitude may be expanded. For example, adding a set of third and fourth nozzles 38*c*, 38*d* may further cause distribution of the vibration to additional side band vibration frequencies. In an exemplary embodiment, a third side band frequency may correspond to the size of the third profile $P_3$, and a fourth side band frequency may correspond to the size of the fourth profile $P_4$, relative to the size of the first and second profiles $P_1$ and $P_2$, such that, for example, a larger third profile $P_3$ will create a lower third side band frequency.

It will be appreciated that, however, that while in general the greater the amplitude in the side band frequencies, the greater the reduction in the peak amplitude at the nominal passing or harmonic frequency, the relationship between (1) the difference of the amplitudes $A_1$-$A_4$ and the reduced amplitudes $A_1'$-$A_4'$ and (2) the amplitudes of the side band frequency vibrations, is not necessarily linear. In fact, the vibration frequencies $F_1'$-$F_4'$, the associated amplitudes $A_1'$-$A_4'$, and side band vibration frequencies and amplitudes may be influenced by additional complexities related to variations in the patterns 42, sizes of the nozzles 38, or other factors. Additionally, complex fluid dynamic or harmonic effects resulting from having, for example, four nozzles 38*a-d* with four different profiles $P_1$-$P_4$, respectively, disposed in one of the various patterns 42, may add additional harmonic or other types of vibrations at frequencies above or below any or all of the four vibration frequencies $F_1'$-$F_4'$ described herein. Such complexities may be computer-modeled using appropriate Computational Fluid Dynamic (CFD) techniques, or determined through product testing, and thus the complexities may be precisely identified during the design of the rotor 16 and stator 18.

Figure 7:
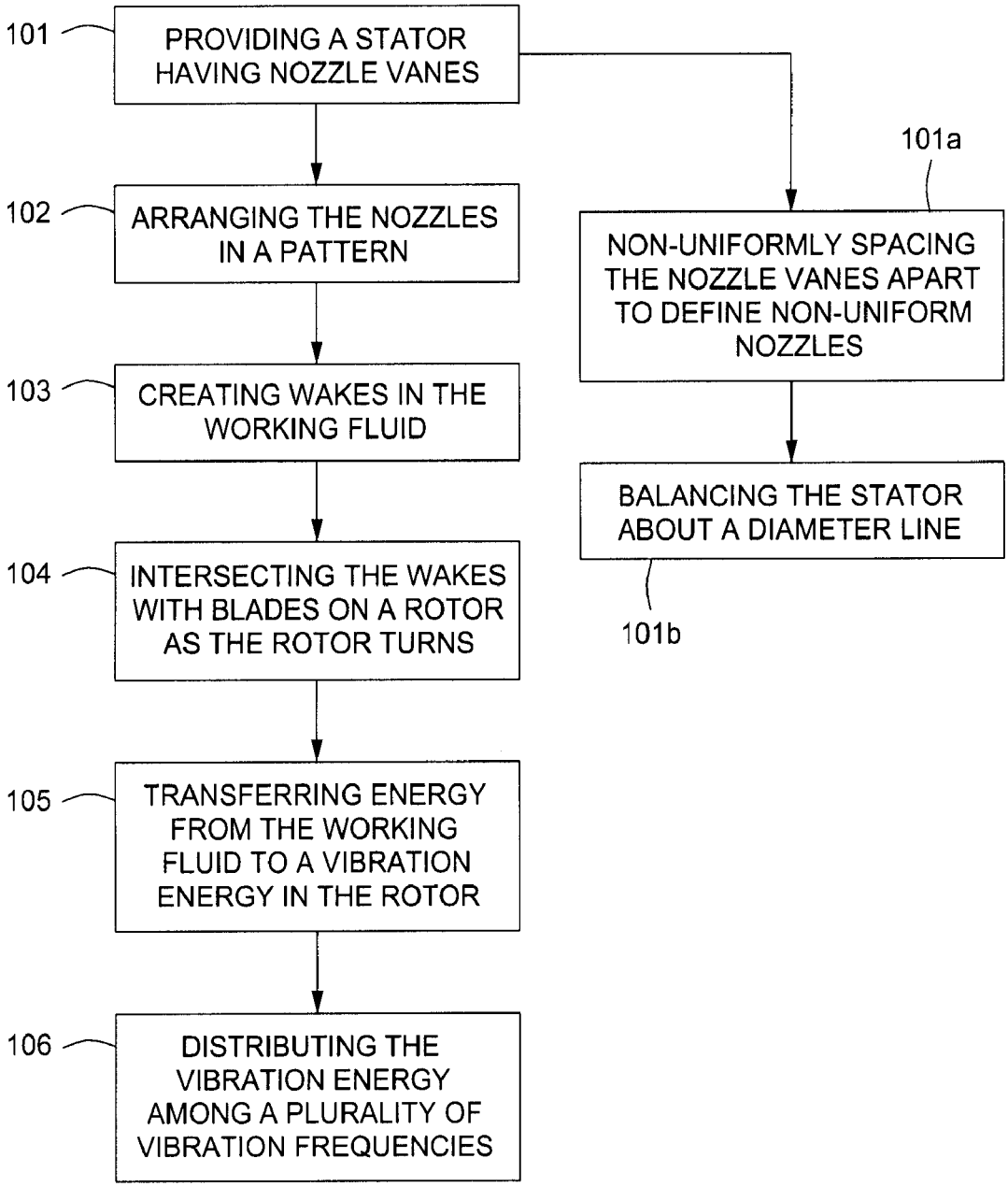
FIG. 7 illustrates a flow chart of an exemplary method of reducing an acoustic signature, in accordance with the disclosure.

FIG. 7 illustrates a flow chart of an exemplary embodiment of a method of reducing an acoustic signature, such as the acoustic signature in the stages 20 or 22, in the turbine 10 described with reference to FIG. 1. With continuing reference to FIG. 1, the method may include providing the stator 16 having the nozzle vanes 24, as at step 101. The step 101 may also include balancing the flow area of the nozzles 38 in the stator 18 about the diametral line 44, as described above with reference to FIGS. 2 and 3. Further, the step 101 may include spacing the nozzle vanes 36 apart non-uniformly to define non-uniform nozzles 38, shown as step 101*a*. The nozzles 38 may be non-uniform in the sense that one nozzle 38 may have a different size profile than another nozzle 38. Accordingly, spacing the nozzle vanes 36 apart non-uniformly may include creating the first, second, third, and fourth nozzles 38*a-d*, with the four profiles $P_{1-4}$ as described in detail with reference to FIG. 3.

The method may also include arranging the nozzles 38 in the pattern 42, shown as step 102. As also described with reference to FIGS. 2 and 3, step 102 may include creating two nozzles 38*a-b*, three nozzles 38*a-c*, or four nozzles 38*a-d*, and spacing the nozzle vanes 38 apart non-uniformly to create the different profiles associated with of the nozzles 38. The pattern 42 of nozzles 38 may be random, may be a repeating sequence of one of the first nozzles 38*a*, one of the second nozzles 38*b*, one of the third nozzles 38*c*, and one of the fourth nozzles 38*d*, may be some other sequence, which may or may not repeat, as described with reference to FIGS. 2 and 3.

The method may also include creating the wakes 52 in the working fluid 50 with the nozzle vanes 36 such that each wake 52 corresponds to one of the nozzle vanes 36, shown as step 103. As shown in FIG. 5, and described above with reference thereto, motivating the working fluid 50 between the nozzle vanes 36 may cause the nozzle vanes 36 to disrupt the flow of the working fluid 50, thereby causing the wakes 52 to form in the working fluid 50. Each wake 52 is proximal to a separate one of the nozzle vanes 36 in the sense that each of the nozzle vanes 36 creates a single wake 52. More particularly, each wake 52 may be proximal to the trailing edge 36*b* of each of the nozzle vanes 36.

The method may further include intersecting the wakes 52 with the blades 24 as the rotor 16 turns, shown as step 104. As the blades 24 are motivated in a circumferential path by the transfer of energy from the working fluid 50 into mechanical rotational energy in the rotor 16, the blades 24 pass through the working fluid 50 flowing through each of the nozzles 38. Once at the circumferential end of the working fluid 50 flowing out of one of the nozzles 38, the blade 24 may encounter or intersect the wake 52 in the working fluid 50, before traversing the wake 52 and passing to the working fluid 50 flowing through the next nozzle 38.

The method may also include transferring energy from the working fluid 50 to vibration energy in the rotor 16, shown as step 105. As the turbine 10 operates, the rotor 16 rotates, causing the blades 24 to proceed along circumferentially past each of the stationary nozzle vanes 36. Each of the blades 24 may thus periodically encounter the wakes 52. As described with reference to FIG. 5, this periodic encountering may lead not only to the transfer of energy to rotational mechanical energy, as described in the preceding paragraph, but also to the transfer of energy from the working fluid 50 to vibration energy in the rotor 16, thereby potentially creating the acoustic signature.

To minimize the intensity of the acoustic signature, the method may include distributing the vibration energy among a plurality of vibration frequencies, including side band frequencies, around a nominal passing frequency and/or around subsequent harmonic frequencies, shown as step 106, by spacing the nozzle vanes 38 apart non-uniformly as described above with reference to FIG. 6B.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A stator for a turbomachine comprising a plurality of nozzle vanes, wherein a distance between each of the plurality of nozzle vanes varies circumferentially around the stator in a repeating pattern configured to distribute a vibration energy over a plurality of side band vibration frequencies around a nominal passing frequency in a rotor; and wherein the distance between each of the plurality of nozzle vanes consecutively alternates between a first distance and a second distance, wherein the second distance is greater than the first distance.

2. The stator of claim 1, further comprising:

a first half;

a second half, wherein a first number of the plurality of nozzle vanes are included in the first half and a second number of the plurality of nozzle vanes are included in the second half, and the distance between each of the plurality of nozzle vanes defines a flow area; and a first sum of the flow areas between the plurality of nozzle vanes in the first half is substantially equal to a second sum of the flow areas between the plurality of nozzle vanes in the second half.

3. The stator of claim 1, further comprising:

an inner endwall having a plurality of inner slots defined therein; and an outer endwall having a plurality of outer slots defined therein, wherein each of the plurality of nozzle vanes is disposed in one of the plurality of inner slots and in one of the plurality of outer slots.

4. The stator of claim 1, wherein the distance between each of the plurality of nozzle vanes defines a nozzle having a profile, wherein varying the distance varies the profile of the nozzle.

5. The stator of claim 1, wherein the plurality of side band vibration frequencies comprise a first side band vibration frequency corresponding to the first distance and a second side band vibration frequency corresponding to the second distance.

6. A turbomachine, comprising:

a rotor; and a stator in fluid communication with the rotor, the stator having first nozzles each having a first profile and second nozzles each having a second profile that is larger than the first profile, wherein the first and second nozzles are disposed in a repeating pattern such that a vibration energy in the rotor is distributed among a plurality of side band vibration frequencies around a nominal passing frequency;

wherein the repeating pattern comprises a repeating sequence in which each one of the first nozzles is adjacent to at least one of the second nozzles, and each one of the second nozzles is adjacent to at least one of the first nozzles.

7. The turbomachine of claim 6, wherein the stator further comprises:

an inner endwall that is ring-shaped and continuous and has inner slots defined therein;

an outer endwall that is ring-shaped and continuous and has outer slots defined therein, wherein the inner endwall and the outer endwall are concentric and the inner endwall is located radially inside the outer endwall; and a plurality of nozzle vanes each extending radially between the inner endwall and the outer endwall and disposed in one of the inner slots and in one of the outer slots.

8. The turbomachine of claim 6, wherein:

each of the first and second nozzles define a flow area;

the stator has a first half and a second half, wherein the first nozzles are distributed between the first and second halves, and the second nozzles are distributed between the first and second halves; and a first sum of the flow areas of the first and second nozzles in the first half is substantially equal to a second sum of the flow areas of the first and second nozzles in the second half.

9. A turbomachine, comprising:

a rotor; and a stator in fluid communication with the rotor, the stator having first nozzles each having a first profile and second nozzles each having a second profile that is larger than the first profile, wherein the first and second nozzles are disposed in a repeating pattern such that a vibration energy in the rotor is distributed among a plurality of side band vibration frequencies around a nominal passing frequency;

wherein the plurality of side band vibration frequencies comprise a first side band vibration frequency corresponding to the first nozzles, and a second side band vibration frequency corresponding to the second nozzles, wherein the second side band vibration frequency is lower than the first side band vibration frequency.

10. The turbomachine of claim 9, wherein the stator further comprises:

third nozzles each having a third profile that is larger than the second profile; and fourth nozzles each having a fourth profile that is larger than the third profile.

11. The turbomachine of claim 10, wherein the repeating pattern comprises a repeating sequence of one of the first nozzles, one of the second nozzles, one of the third nozzles, and one of the fourth nozzles.

12. A method of reducing an acoustic signature, comprising:

providing a stator having nozzle vanes;

spacing the nozzle vanes apart non-uniformly to define non-uniform nozzles therebetween, wherein the non-uniform nozzles are arranged in a repeating pattern;

creating wakes in a working fluid using the nozzle vanes, wherein each of the wakes corresponds to a separate one of the nozzle vanes;

intersecting the wakes with blades on a rotor as the rotor turns;

transferring energy from the working fluid to a vibration energy in the rotor; and distributing the vibration energy among a plurality of side band vibration frequencies around a nominal passing frequency, wherein the non-uniform nozzles comprise a first nozzle having a first profile, a second nozzle having a second profile that is larger than the first profile, a third nozzle having a third profile that is larger than the second profile, and a fourth nozzle having a fourth profile that is larger than the third profile.

13. The method of claim 12, wherein the plurality of side band vibration frequencies comprise a first side band vibration frequency corresponding to the first nozzle, a second side band vibration frequency corresponding to the second nozzle, a third side band vibration frequency corresponding to the third nozzle, and a fourth side band vibration frequency corresponding to the fourth nozzle.

14. The method of claim 13, further comprising balancing the stator about a diametral line such that a first sum of flow areas in a first half of the stator is substantially equal to a second sum of flow areas in a second half of the stator.

15. A method of reducing an acoustic signature, comprising:

providing a stator having nozzle vanes;

spacing the nozzle vanes apart non-uniformly to define non-uniform nozzles therebetween, wherein the non-uniform nozzles are arranged in a repeating pattern;

creating wakes in a working fluid using the nozzle vanes, wherein each of the wakes corresponds to a separate one of the nozzle vanes;

intersecting the wakes with blades on a rotor as the rotor turns;

transferring enemy from the working fluid to a vibration energy in the rotor; and distributing the vibration energy among a plurality of side band vibration frequencies around a nominal passing frequency, wherein the non-uniform nozzles further comprise:

a plurality of first nozzles each having a first profile;

a plurality of second nozzles each having a second profile that is larger than the first profile;

a plurality of third nozzles each having a third profile that is larger than the second profile; and a plurality of fourth nozzles each having a fourth profile that is larger than the third profile, wherein the pattern comprises a repeating sequence of at least one of the plurality of first nozzles, at least one of the plurality of second nozzles, at least one of the plurality of third nozzles, and at least one of the plurality of fourth nozzles.

* * * * *